US005570883A

United States Patent [19]

Csabai

[11] Patent Number: 5,570,883

[45] Date of Patent: Nov. 5, 1996

[54] SPORT RACKET WITH STRING STABILIZATION AND FRICTION COATING

[76] Inventor: Julius S. Csabai, 22 Normandy Road, Baie D'Urfe, Quebec, Canada, H9X 3E6

[21] Appl. No.: 493,077

[22] Filed: Jun. 21, 1995

[30] Foreign Application Priority Data

Jul. 4, 1994 [CA] Canada ..... 2127324

[51] Int. Cl.[6] ..... A63B 51/02

[52] U.S. Cl. ..... 273/73 D

[58] Field of Search ..... 273/73 R, 73 C, 273/73 D

[56] References Cited

U.S. PATENT DOCUMENTS

| | | | |
|---|---|---|---|
| 1,682,199 | 8/1928 | Smilie . | |
| 3,834,699 | 9/1974 | Pass . | |
| 3,920,658 | 11/1975 | Benson | 273/73 R X |
| 3,926,431 | 12/1975 | DeLorean | 273/73 D |
| 4,078,796 | 3/1978 | Gibello . | |
| 4,095,790 | 6/1978 | Swiecicki . | |
| 4,238,262 | 12/1980 | Fishel | 273/73 D X |
| 4,249,731 | 2/1981 | Amster . | |
| 4,685,676 | 8/1987 | Boden . | |

FOREIGN PATENT DOCUMENTS

| | | | |
|---|---|---|---|
| 698267 | 1/1931 | France . | |
| 2651140 | 3/1991 | France | 273/73 D |
| 3218899 | 6/1983 | Germany | 273/73 R |
| 3620083 | 12/1987 | Germany | 273/73 D |
| 40/50664670 | 3/1993 | Japan | 273/73 R |

*Primary Examiner*—Raleigh W. Chiu
*Attorney, Agent, or Firm*—Keck, Mahin & Cate

[57] ABSTRACT

A method is provided of stabilizing a sport racket strung with synthetic strings, such as nylon strings, and imparting thereto additional friction that enables to achieve improved ball control during play, which comprises: roughening the strings at least in the main hitting area of the racket; coating the roughened strings with a polymer capable of stabilizing the strings and providing the same with extra friction; and curing the polymer on the strings so as to produce an essentially permanent polymeric coating at least in the main hitting area of the racket. Also the improved racket treated in accordance with the above method is part of the present invention.

19 Claims, 3 Drawing Sheets

SPORT RACKET WITH STRING STABILIZATION AND FRICTION COATING

TECHNICAL FIELD

This invention relates to sport rackets, such as tennis rackets, squash rackets, badminton rackets and the like, which are provided with string stabilization and friction coating. Moreover, the invention relates to a method of treating racket strings to achieve desired properties of stabilization and friction therein.

BACKGROUND OF THE INVENTION

It is well known that the older generation of wooden frame rackets were strung with natural guts which were processed from resilient tissues of animal fibers. These shredded gut fibers formed into strings needed a protective coating to prevent moisture penetration, as the dry uncoated gut tissues were good moisture absorbents. Because the moisture would change the playing properties of natural guts, it was very important to coat them, after stringing the racket, in order to lock out the moisture.

Moreover, natural guts where subject to rapid wearing out of the strings due to friction at the string crossings and the impact of the ball. This is described, for instance, in U.S. Pat. No. 1,682,199 of Aug. 28, 1928 where it is proposed to use double concave discs interposed between the strings to prevent their bruising and wearing, and in French Patent No. 698,267 of Jul. 1, 1930 where a coating is provided to protect the strings from wearing out too rapidly and where the adhesive substance, such as a varnish, is used in a sufficient quantity to also bond the strings at their cross-over points and thereby protect them not only from the impact of the ball, but also from friction of the strings against one another.

In the past, the absorbent nature of natural guts made the application of protective coating easy because the varnish or lacquer could readily penetrate the fibrous structure for reliable adhesion.

Since the advent of synthetic strings, the need for coating became unnecessary, and presently the rackets are being strung without any coatings. The only type of coating that is still commonly applied is for decorative purposes, mostly in the form of the sponsor's promotional logo and the like. Presently employed synthetic strings are usually manufactured from nylon. The reason for this is that nylon monofilaments have excellent durability, strength and resilience, which is achieved by extrusion moulding, followed by molecular orientation through several levels of linear stretching. However, nylon is also known to have one of the lowest coefficient of friction amongst plastics; this unique smoothness or "slippery" property of nylon is widely exploited by the industry to make bearings and other sliding surfaces.

It is, therefore, not surprising that balls, such as tennis balls, tend to slip or slide on the nylon strings, particularly when a tangential shot is made by the player.

Furthermore, due to the above mentioned slippery nature of nylon strings and nylon's relatively low chemical solubility, cementing an adhesive coating on such strings in order to achieve higher friction surfaces is virtually impossible. For this reason, a number of patents have issued for inventions which provide a variety of devices that can be used with or attached to the tennis strings to improve the frictional forces between the ball and the synthetic guts.

Examples of such patents are U.S. Pat. No. 4,078,796 dated Mar. 14, 1978; U.S. Pat. No. 4,095,790 dated Jun. 20, 1978; and U.S. Pat. No. 4,685,676 dated Aug. 11, 1987.

Other prior art patents, such as U.S. Pat. No. 4,249,731 of Feb. 10, 1981, disclose tubular sleeves over the strings which can be bonded together at cross points.

Apart from achieving higher friction surfaces, it may be desirable to consolidate the strings within the racket by bonding the cross-over points thereof, at least within the hitting area of the racket, so that the string would not move during play. This could be done with the porous natural fibers as disclosed in French Patent No. 698,267 already mentioned above. Also in U.S. Pat. No. 3,834,699 of Sep. 10, 1974 the strings are indicated to be welded or bonded by adhesive at cross-over points, but without interweaving the same.

In the various patents mentioned above, the racket must either be modified in the string construction or some further elements or features must be added thereto in order to impart extra spin to the ball during play by reducing the slippery effect of the synthetic strings. These operations are often cumbersome and rather complex in nature and, for this reason, few of them have achieved a practical application.

SUMMARY OF THE INVENTION

An object of the present invention is to overcome the disadvantages of the prior art and to provide a simple and efficient method of stabilizing a sport racket strung with synthetic strings, such as those made of nylon, as well as imparting thereto additional friction that enables to impart extra spin to a ball hit with such racket.

Another object is to provide an improved sport racket strung with synthetic strings, such as those made of nylon, which strings, at least in the main hitting area of the racket, are provided with an essentially permanent polymeric coating that stabilizes the strings and imparts thereto additional friction which enables to impart extra spin to the ball.

Other objects and advantages of the present invention will become apparent from the following description thereof.

In accordance with the present invention, a method has been devised whereby a polymeric coating of high friction coefficient can be deposited at least over the hitting area of a strung racket, which firmly adheres to the synthetic guts. The principle of this invention is a combined technology of surface roughening or scarification of the smooth synthetic string finish, and a special coating whereby an elastic polymer skin adheres to and shrinks on the roughened or scarified strings in an essentially permanent manner, meaning that there is produced a strong adherence of the coating which will not easily peel off or otherwise be damaged once it has been applied to the strings and cured.

The first step in the method of the present invention is the surface preparation of the strings within the area of the racket which is to be coated. It should be noted that all synthetic strings have a very smooth and polished surface which is due to the extrusion process used in their manufacture. Such smooth surface is not suitable for achieving good adhesion of a polymeric material since a polymer will not readily bond to a smooth or slippery surface.

For this reason the present invention provides for a surface pre-treatment consistings of roughening of the string surface and thereby provide for an essentially permanent adhesion between the polymeric coating and the string material. The surface roughening of the strings significantly increases the surface area to which the polymer will adhere and, in addition, provides a multitude of miniature anchors which assist in the bonding process as they prevent the subsequently applied polymeric coating from loosening or sliding on the strings when the hitting force of the ball is applied thereto.

This roughening of the strings, also referred herein by the name "scarification" can be achieved in several ways, such as sand blastings, sand paper or abrasive pad scouring, or wire brushing. The sand blastings technique gives the best results since it provides a very pronounced, three dimensional and multi-directional anchor profile in the form of pitted surface which is most satisfactory for achieving an excellent adhesion of the subsequent polymeric coating. However, such technique is not normally intended for a home application and would usually be offered only by specialty pro shops or similar sporting service providers equipped with the specialized blastings gun and other tools required for this purpose. However, the roughening or scarification of the string surface in accordance with the present invention can also be satisfactorily performed by scrubbing the surface of the strings to be coated with sand paper or an abrasive pad or with a wire brush or the like. About five to ten minutes of scrubbing with such devices in both lengthwise and cross-wise directions on the string plane, on both sides of the racket, will provide adequate surface preparation required prior to the liquid polymer application. In fact a microscopic surface examination of scarified string samples revealed that abrasive pad scrubbing nearly doubles the effective surface area used for coating, whereas sandblastings with mineral grits, such as garnet, more that triples it.

It should also be pointed out that the strings could also be subjected to scarification before they are strung on the racket. This could be done, for example, by supplementing the technology of string extrusion with a subsequent sand blastings step or other means which could provide the strings with a three-dimensional surface roughness and a substantial increase of the active surface area required for the polymer coating application.

The second step of the method pursuant to the present invention is the coating of the roughened or scarified strings with a suitable polymeric material. This coating is normally done only in the hitting area of the racket, but it could also be performed on the entire string surface of the racket particularly if factory scarified strings are used for stringing the racket as already mentioned above.

The polymer deposition on the strings of a sport racket pursuant to this invention is intended to achieve a very strong adherence of the polymer to the strings, called herein an essentially permanent coating, which is due to a combination of the adhesive properties of the polymer itself and the anchoring effect of the surface roughness acquired by the string during scarification as already mentioned above. This polymer adhesion must also be achieved without any chemical attack on or any dissolving of the string material.

Thus, after roughening or scarification as already described above, at least the hitting area of the racket, including the string plane and the cross-over or intersection points of the strings, are coated with a liquid polymeric material having predetermined properties of adhesion, elasticity, tensile strength, tear strength and abrasion resistance as well as rheology. The polymer is deposited in sufficient amount to fill any free space or cavities at and around the cross-over points of the strings and, in addition, to provide a thin layer of the polymer over the strings themselves within the entire treated area of the string plane on both sides of the racket. The combination of the polymer strength and thickness of deposit should preferably approach the rupture resistance of the strings.

The liquid polymer can be applied in any suitable manner, although the most practical and efficient way has been found to be with the use of liquid dispensers followed by brushing. This avoids considerable waste of material when compared to spraying or a roller application. The liquid dispensers are well known in the art and are widely used. The simplest type of such a dispenser is a flat, squizable, plastic tube or bottle. A more elaborate type is a plunger activated syringe which can be operated manually or with the assistance of a power drive. In fact there are a number of advanced models of plunger dispensers available on the market, which are powered by air or electric drives; they offer a wide range of automation options for volumatic proportioning and time cycles, including programmable controls, and could be used to provide a very satisfactory application of the polymeric material in accordance with this invention.

All such dispensers discharge the liquid through a tapered tip or nozzle which must be such as to provide a continuous liquid flow without plugging or dripping. In this manner the liquid polymer can be directly applied to the required area of the strings without any waste.

The application of the liquid polymer could first be done at the intersections or cross-over points of the strings in the area of the racket where coating is to be applied. Once these cross-over points are sealed with the liquid polymer, they would normally be permitted to harden until they are somewhat solidified (2–3 hrs) before proceeding with the remainder of the application. Then a thin, even layer of polymer would be applied to the overall string surface with the use of the liquid polymer dispenser followed by brushing, for instance, with a thin and fine fiber brush.

The polymers that may be used in accordance with the present invention are such that will achieve an essentially permanent bonding with the roughened strings of the racket and provide the desired stabilization and frictional effect allowing to produce the extra spin on the ball. To satisfy the above requirements, such polymers, when used, should normally have the following properties:

Tensile Strength≧3000 psi (20,700 kPa)

Tear Strength≧200 pli (36 Kgf/cm)

Elongation 100%–300% preferably about 200%

Hardness (Shore D) 30–50, preferably about 40

Adhesion≧45 pli (8 Kgf/cm)

Taber Abrasion Resistance≦20

In the above table, pli means pounds per linear inch and Kgf/cm means kilogram force per centimeter.

A number of commercially available liquid polymers meet the above requirements. For example, a number of polyurethanes will have such properties including a very good adhesion to nylon (the most commonly used synthetic gut for racket strings). Such polyurethanes come in either single or two component formulas.

In the single component variety water dispersible polyurethane elastomers produced by DOW CHEMICALS give good results. These fully reacted, aliphatic, thermoplastic urethanes dispersed in water and amines are very suitable for application by brush, since the brush can then be rinsed out in water.

Suitable two component polyurethanes are, for example IRATHANE™ 141 and IRATHANE™ 155 produced by DEVON CORPORATION. These two component polyurethanes provide excellent adhesion to synthetic plastics, such as nylon, and have good resistance to abrasive wear. In these urethanes the polymeric component provides the basic chemical structure of the elastic coating, while the other component provides the curative or catalytic effect that promotes the cross-linking between the polymer chains. The two components are normally mixed in equal ratios.

Other suitable liquid polymers are epoxy resins which have the above mentioned properties and which also usually come in two component formulas.

It should also be pointed out that for proper application, the liquid polymers should have adequate viscosity. If the material is too thin it will easily run off the strings and will not deposit in sufficient quantity at the intersections. On the other hand, if it is too viscous it has a tendency to form too thick a layer on the strings themselves, without adequate penetration at the intersections where it is most needed. It has been found that a polymer of Brookfield viscosity of between 100 and 3000 measured in Stokes at 25° C. produces satisfactory results for the purposes of the present invention.

Finally, the third and last step is to cure the polymer on the strings. The curing will depend on the type of polymer used and the manufacturer of the polymer will usually provide the information on the temperature and time required to cure the resin. In the case of two component polyurethanes the curing is usually done at room temperature for a period of between 48 and 72 hours. During the curing operation the polymer shrinks resulting in enhanced adhesion to the strings. Thereafter, the racket is ready to be used in play.

BRIEF DESCRIPTION OF THE DRAWINGS

The invention will now be described with reference to the appended drawings in which.

DETAILED DESCRIPTION OF THE INVENTION

Figure 1:
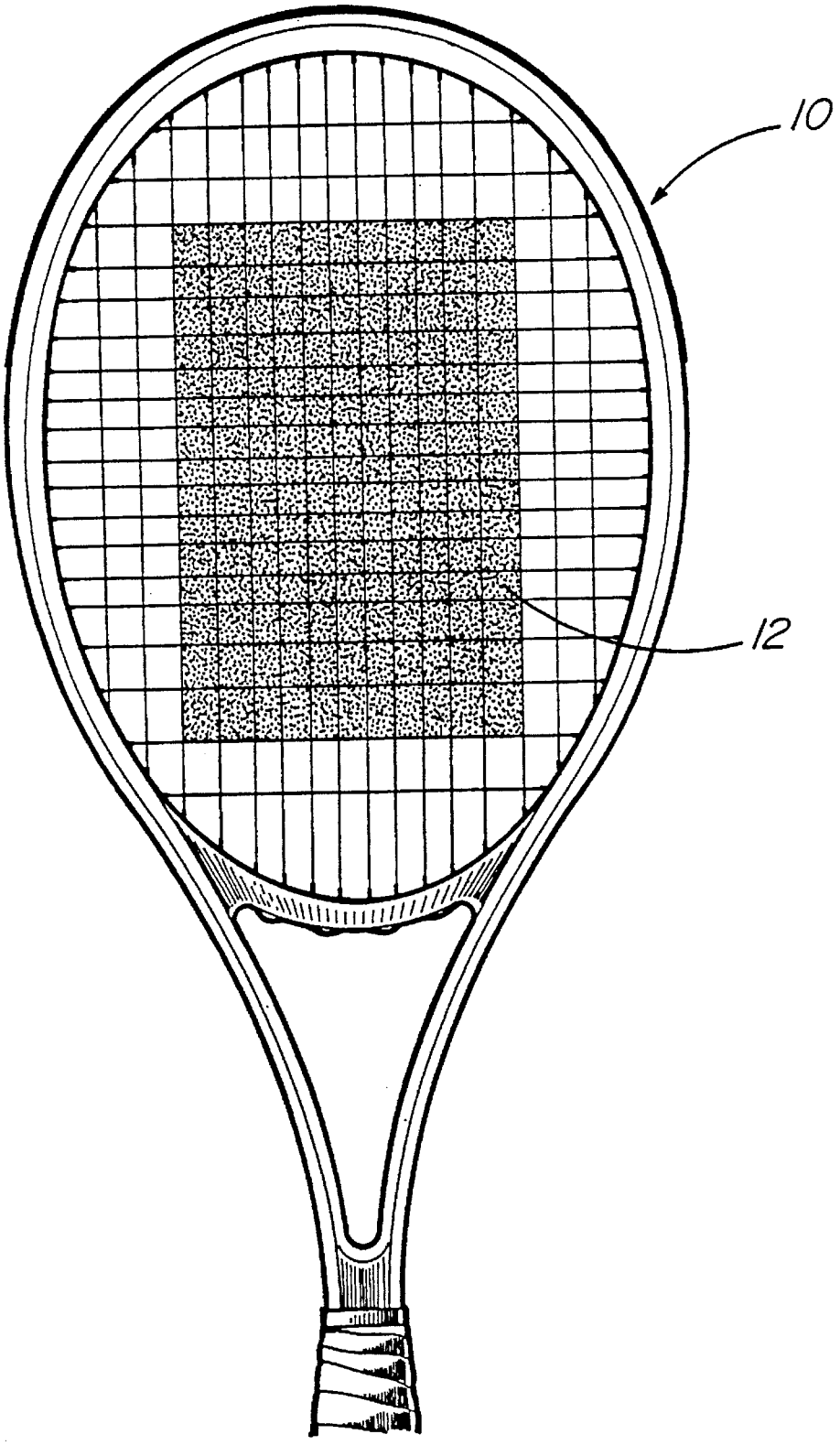
FIG. 1 is a plan view of a sport racket showing the main hitting area in the middle thereof.

Referring to FIG. 1, it shows a tennis racket 10 where the main ball hitting area 12, in the middle of the racket, is shaded. Although the present invention would apply to any sport racket, tennis is certainly the most popular racket sport which encompasses most aspects and complexities of all racket sports and for this reason this preferred embodiment of the invention refers to a tennis racket. Also, although the entire string surface of the racket could be treated in accordance with the present invention, normally it is sufficient to so treat only the hitting area 12 which, as a first step, is roughened or scarified as already described previously.

Figure 2A:
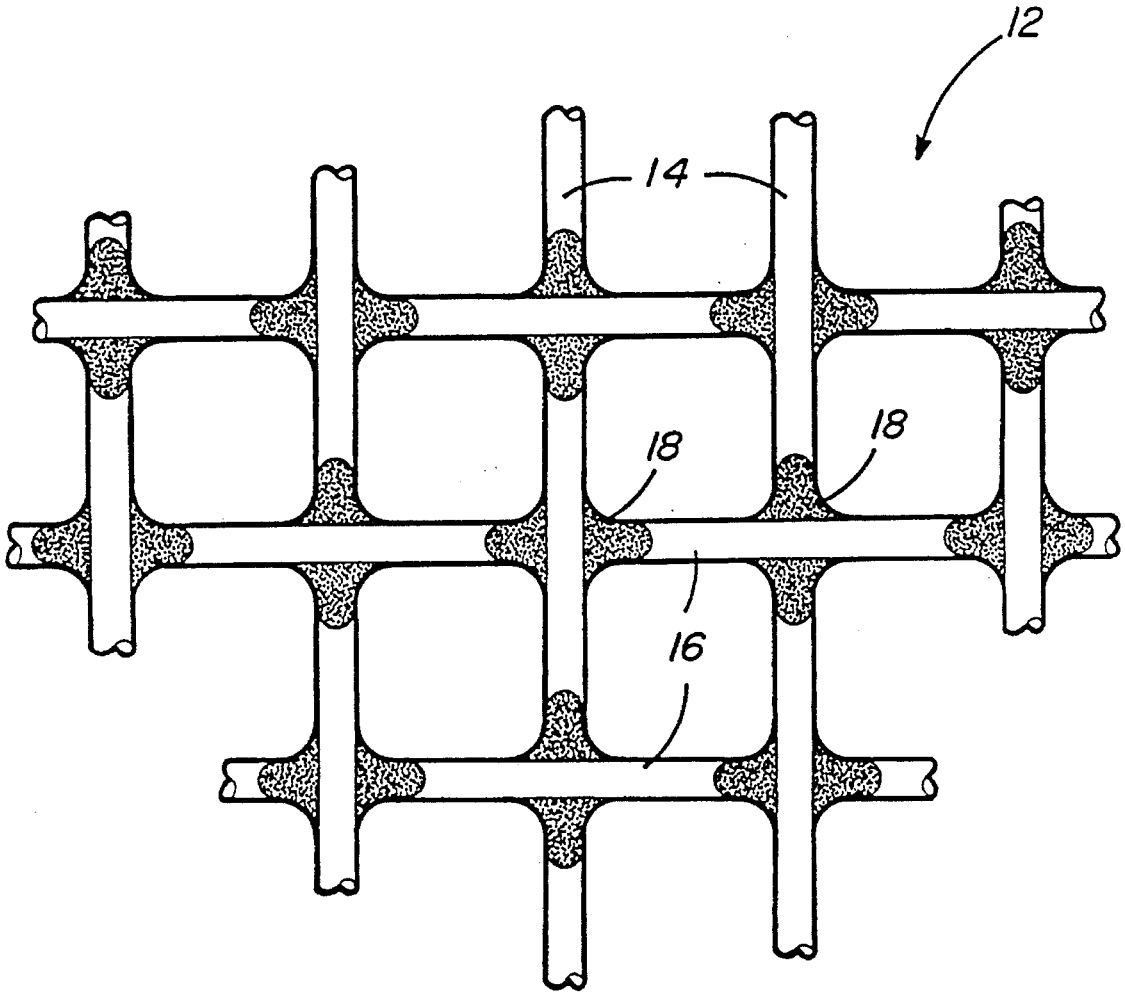
FIG. 2A is a plan view of a portion of the hitting area shown in FIG. 1 showing the polymeric material at the cross-over points of the strings.
Figure 2B:
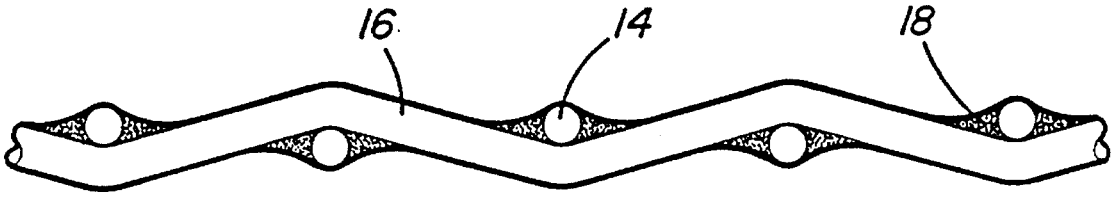
FIG. 2B is a side view of the same portion as shown in FIG. 2A.

FIGS. 2A and 2B show respectively a plan view and side view of the strings within area 12 which are interwoven in the usual manner and wherein the polymer application pursuant to the preferred embodiment of the present invention has begun. According to this embodiment the two components of IRATHANE™ 141 polymer are mixed with one another and the mixture is placed in a plastic bottle equipped with a twist cap having a tapered tip. The polymeric mixture is then applied through the tip to the intersections between longitudinal strings 14 and cross strings 16 in the hitting area 12 of the racket. The amount of polymer 18 used is such as to essentially fill the cavity or space between the strings at the cross-over points as illustrated particularly in FIG. 2B.

Figure 3A:
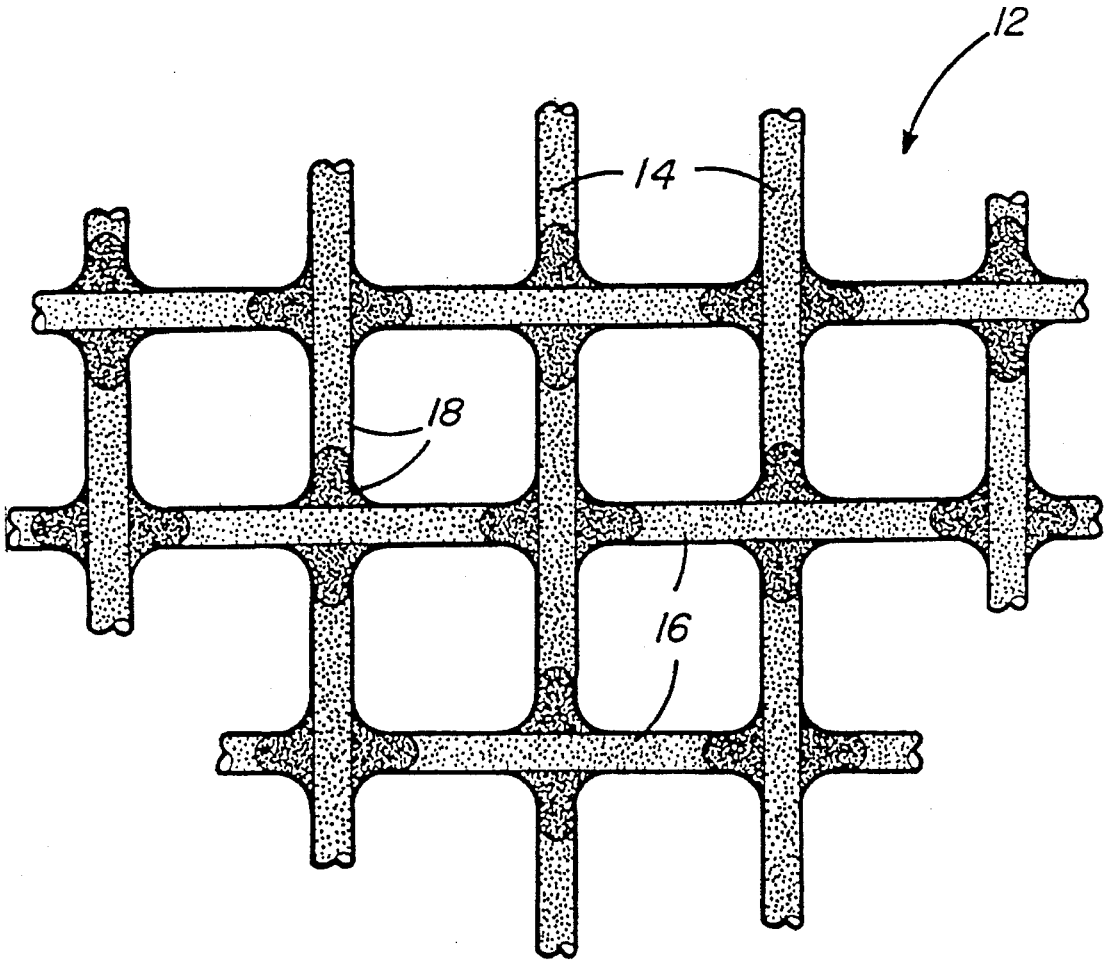
FIG. 3A is a plan view similar to that shown in FIG. 2A, but with polymeric material also coating the strings themselves.
Figure 3B:
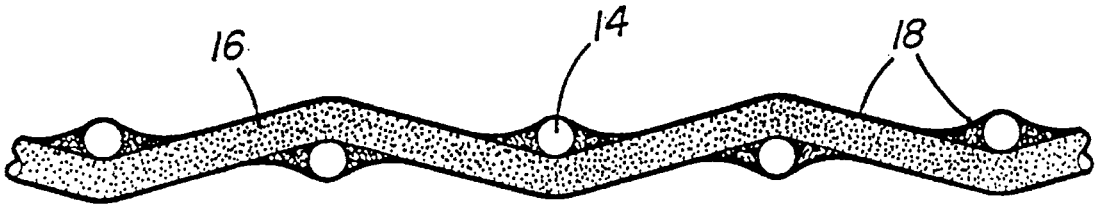
FIG. 3B is a side view of the same portion as shown in FIG. 3A.

Once the above operation has been performed the polymer is permitted to harden at room temperature for about 2–3 hrs. Then, a thin layer of the polymer 18 is applied onto the entire surface of the strings 14 and 16 using the same plastic bottle dispenser followed by brushing for example with a super thin flat 2 inch wide brush of which the bristle setting is 1.5 mm (1/16") thick and the length of the bristle is 2 cm (3/4"). This brush has been selected because it provides minimal resistance to bending and covers the racket hitting string area with only a few strokes in each direction on both sides of the racket. It also fits into the cover cap of a tennis ball canister for storage. A thin coating of polymer 18 is thus applied over the entire hitting area 12 of the racket as shown in FIGS. 3A and 3B. Thereafter, the polymer is allowed to cure at room temperature for a period of about 72 hrs.

The treatment in accordance with the present invention produces a considerable improvement in the racket. Since the strings are flexibly connected together by the polymer coating, the independence of lateral movement of the individual strings is lost. It is well known in this regard that out-of-allignment strings are under greatly increased tension, which results in a loss of control during play. The present invention eliminates this problem. After treatment, the entire treated plane of the string network responds to the ball impact in unison due to its elastic interconnection. Thus, the ball impacting force is shared by all of the interconnected main and cross strings. Due to this load sharing, the tension in the treated strings is much less than in the standard untreated racket. Empirical testings indicates that in order to produce the same force response as the untreated strings, the treated stringing requires 10 to 15 lbs (4.5 to 7 kg) less tension.

The end result is that the string treatment in accordance with the present invention combines the dual benefit of more power and improved ball control at the same time, particularly since the coating of polymeric material also produces a better friction on the strings which results in better traction force on the ball. This added friction force further improves the capability of the racket to impart extra spin on the ball and thus to make pronounced tangential shots.

The invention has been described above in the form of a preferred embodiment, but it should by understood that many modifications can be made therein, which are obvious to those skilled in the art, without departing from the spirit of the invention and the scope of the following claims.

I claim:

1. A sport racket strung with synthetic strings, a middle portion of which constitutes a main hitting area of the racket, said strings, at least in said hitting area, having been roughened and having an essentially permanent polymeric coating on the roughened strings which stabilizes the strings within the racket and imparts thereto additional friction that enables to achieve improved ball control during play.

2. A racket according to claim 1, wherein the strings are strung in an interwoven manner.

3. A racket according to claim 1, wherein the strings are made of nylon.

4. A racket according to claim 1, wherein the polymeric coating is made of a polymer which has the following properties:

Tensile Strength≧3000 psi (20,700 kPa)

Tear Strength≧200 pli (36 Kgt/cm)

Elongation 100%–300%,

Hardness (Shore D) 30–50,

Adhesion≧45 pli (8 Kgf/cm)

Taber Abrasion Resistance≦20.

5. A racket according to claim 4, wherein the polymeric coating is a polyurethane coating.

6. A racket according to claim 4, wherein the polymeric coating is a coating of epoxy resin.

7. A racket according to claim 1, wherein more polymeric coating is provided at cross-over points between the strings, than on the strings themselves.

8. A racket according to claim 7, wherein the polymeric coating at the cross-over points of the strings essentially fills the space or cavity around these points.

9. A racket according to claim 1, which is a tennis racket.

10. A method of stabilizing a sport racket strung with synthetic strings and imparting thereto additional friction, which comprises:

(a) roughening the strings a least in a main hitting area of the racket;

(b) coating the roughened strings with a polymer capable of stabilizing said strings and imparting thereto additional friction; and (c) curing said polymer on said strings so as to produce an essentially permanent polymeric coating at least in said main hitting area of the racket.

11. A method according to claim 10, wherein in lieu of roughening the strings, pre-roughened strings are used for stringing the racket.

12. A method according to claim 10, wherein said strings are made of nylon.

13. A method according to claim 10, wherein the strings are coated so as to deposit more polymer at the cross-over points of the strings than on the strings themselves.

14. A method according to claim 13, wherein the coating is carried out so that the deposit of polymer at the cross-over points essentially fills the space or cavity around these points.

15. A method according to claim 10, wherein the polymer with which the strings are coated has a Brookfield viscosity of 100–3000 Stokes at 25° C. and, in cured condition, has the following properties:

Tensile Strength≧3000 psi (20,700 kPa)

Tear Strength≧200 pli (36 Kgf/cm)

Elongation 100%–300%,

Hardness (Shore D) 30–50,

Adhesion≧45 pli (8 Kgf/cm)

Taber Abrasion Resistance≦20.

16. A method according to claim 15, wherein said polymer is selected from polyurethanes and epoxy resins.

17. A method according to claim 15, wherein said polymer is applied by means of a liquid dispenser and brushing.

18. A method according to claim 10, wherein curing of the polymer is carried out by maintaining the coated surface at ambient temperature for a sufficient period of time to provide an essentially permanent coating of the polymer on the strings.

19. A method according to claim 18, in which the polymer is cured at room temperature over a period of 48–72 hours.

* * * * *